US006152124A

United States Patent [19]

Gallops, Jr.

[11] Patent Number: 6,152,124

[45] Date of Patent: Nov. 28, 2000

[54] ARCHERY BOW HAVING AN INCREMENTALLY ADJUSTABLE CABLE GUARD

[76] Inventor: Henry M. Gallops, Jr., 5419 NW. 52 Ter., Gainesville, Fla. 32653

[21] Appl. No.: 09/368,823

[22] Filed: Aug. 5, 1999

[51] Int. Cl.[7] ..... F41B 5/10

[52] U.S. Cl. ..... 124/25.6; 124/86

[58] Field of Search ..... 124/25.6, 86, 88

[56] References Cited

U.S. PATENT DOCUMENTS 4,452,222 6/1984 Quartino et al. ..... 124/25.6 X
5,178,122 1/1993 Simonds ..... 124/25.6
5,331,941 7/1994 Schaffer ..... 124/25.6 X
5,531,211 7/1996 Wilfong ..... 124/86
5,718,213 2/1998 Gallops et al. ..... 124/25.6

*Primary Examiner*—John A. Ricci
*Attorney, Agent, or Firm*—Malina & Wolson

[57] ABSTRACT

A compound archery bow having an incrementally adjustable cable guard for permitting the cable restrainer and bowstring to be as close as practicable while permitting the free passage of an arrow therebetween. The cable restrainer is mounted on a support arm which is removably fixed to the handle so that the distance between the support arm and the bowstring may be laterally varied.

20 Claims, 14 Drawing Sheets

14
12
36
10
54
8
21
20
37
12
14

56
58
37

FIG. 4
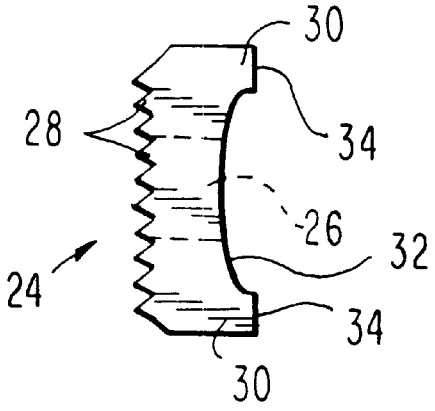
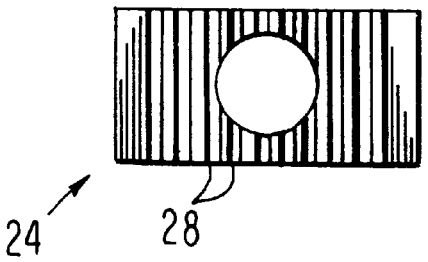
FIG. 4A
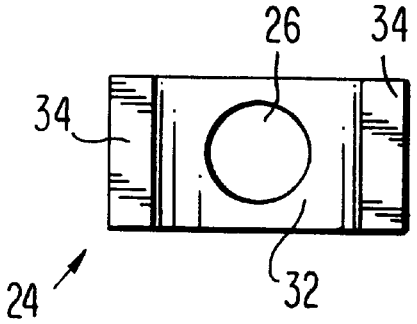
FIG. 4B

FIG. 9
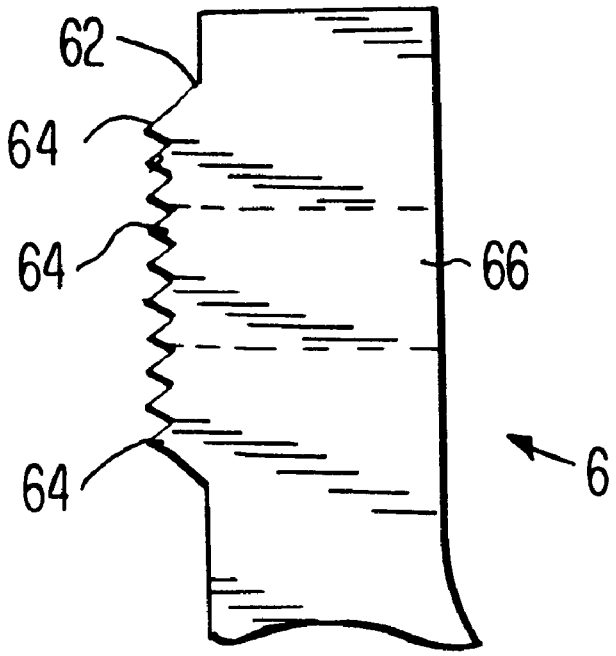
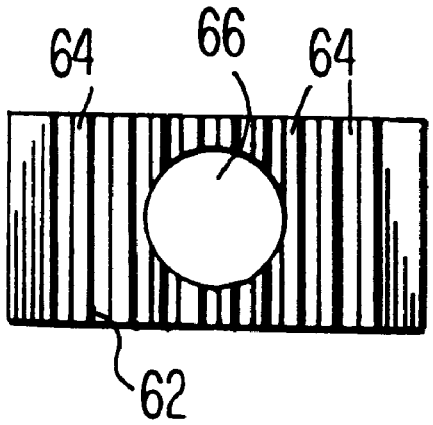
FIG. 9A

ARCHERY BOW HAVING AN INCREMENTALLY ADJUSTABLE CABLE GUARD

This invention relates to an archery bow having an incrementally adjustable cable guard, wherein the distance between the cable retaining means of the cable guard and the bowstring is incrementally adjustable so that the distance is as close as practicable while still permitting the free passage of an arrow.

BACKGROUND OF THE INVENTION

Cable guards are utilized in compound archery bows when the cable and bowstring are too closely spaced laterally to permit the free passage of an arrow. The cable guard separates the cables and bowstring so that the arrow may pass therebetween. One such cable guard is disclosed in U.S. Pat. No. 5,718,213, "Swing Arm Cable Guard", wherein the applicant is a co-inventor. This patent discloses a cable guard including a support member having a swing arm pivotally connected thereto at an angle. A cable retaining means having two bores therein for retaining the cables is pivotally mounted on the other end of the swing arm. The angle between the support member and the swing arm is such that when the bow is drawn, the distance between the cables, which are contained in the cable retaining means, and the plane of the bowstring travel, is less than the distance between the cables and the plane of bowstring travel when the bow is at rest. Since the cables are closer to the plane of bowstring travel when the bow is drawn, the cables and bow limbs are less stressed when the bow is drawn. The cable guard retaining means may not be adjusted to change the distance between the cable guard retaining means and bowstring.

SUMMARY OF THE INVENTION

In order to minimize the amount of torque exerted on the bow and other bow components, the distance between the cable retaining means and the bowstring should be as close as practicable while still permitting the free passage of the arrow. The distance between the cable guard retaining means and bowstring required for the free passage of the arrow may, however, be varied, because it depends on the width of the fletching of the particular arrow being shot. According to the present invention, the location of the cable guard retaining means may be incrementally adjusted so that the distance between the cable retaining means and the bowstring is as close as practicable while still permitting the free passage of the arrow.

It is therefore an object of the present invention to provide an incrementally adjustable cable guard whereby the distance between it and the bowstring may be as close as practicable while still permitting the free passage of the arrow being shot.

Other objects and attendant advantages of this invention will be readily appreciated as the same become better understood by references to the following detailed description when considered in connection with the accompanying drawings in which like reference numerals designate like parts throughout the figures thereof.

A more complete understanding of the present invention will be had with reference to the following detailed description when read in conjunction with the accompanying drawings wherein like reference characters designate like parts throughout the figures thereof.

BRIEF DESCRIPTION OF THE DRAWINGS

FIG. 4 is an exploded top view of the adjustment guide shown in FIG. 2.

FIG. 4A is an exploded elevation view of a first side of the adjustment guide shown in FIG. 2.

FIG. 4B is an exploded elevation view of a second side of the adjustment guide shown in FIG. 2.

FIG. 9 is an exploded top view of a portion of the archery bow handle shown in FIG. 7 to which the cable guard of the present invention is attached.

FIG. 9A is an exploded elevation view of the side of the archery bow handle shown in FIG. 9.

DETAILED DESCRIPTION OF THE PREFERRED EMBODIMENT

Figure 1:
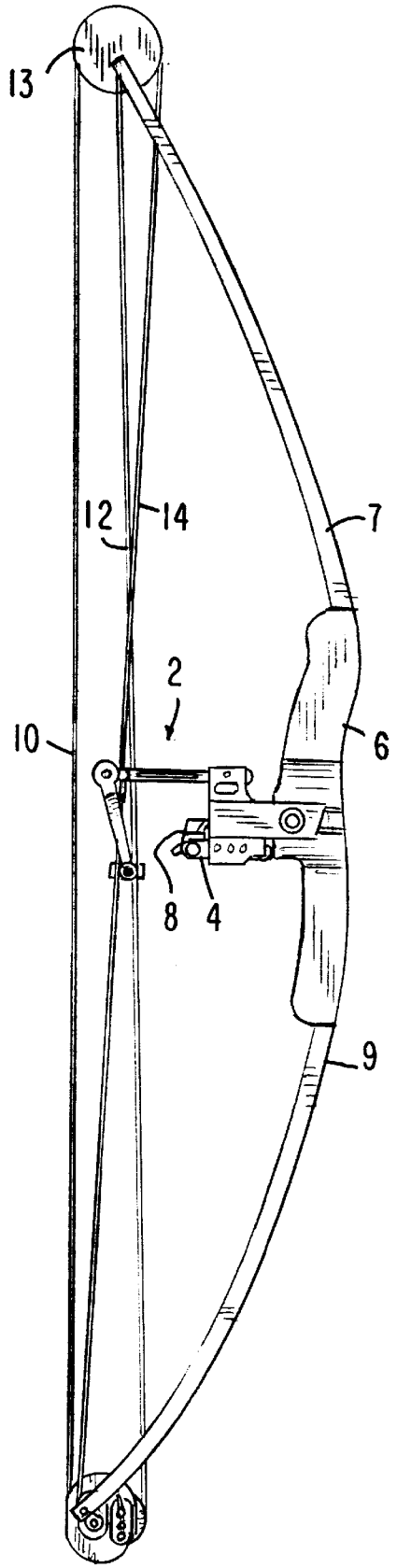
FIG. 1 is a side elevation view of an archery bow the incrementally adjustable compound archery bow cable guard of the present invention wherein the cable guard is connected to the bow handle by an adjustment guide.
Figure 3:
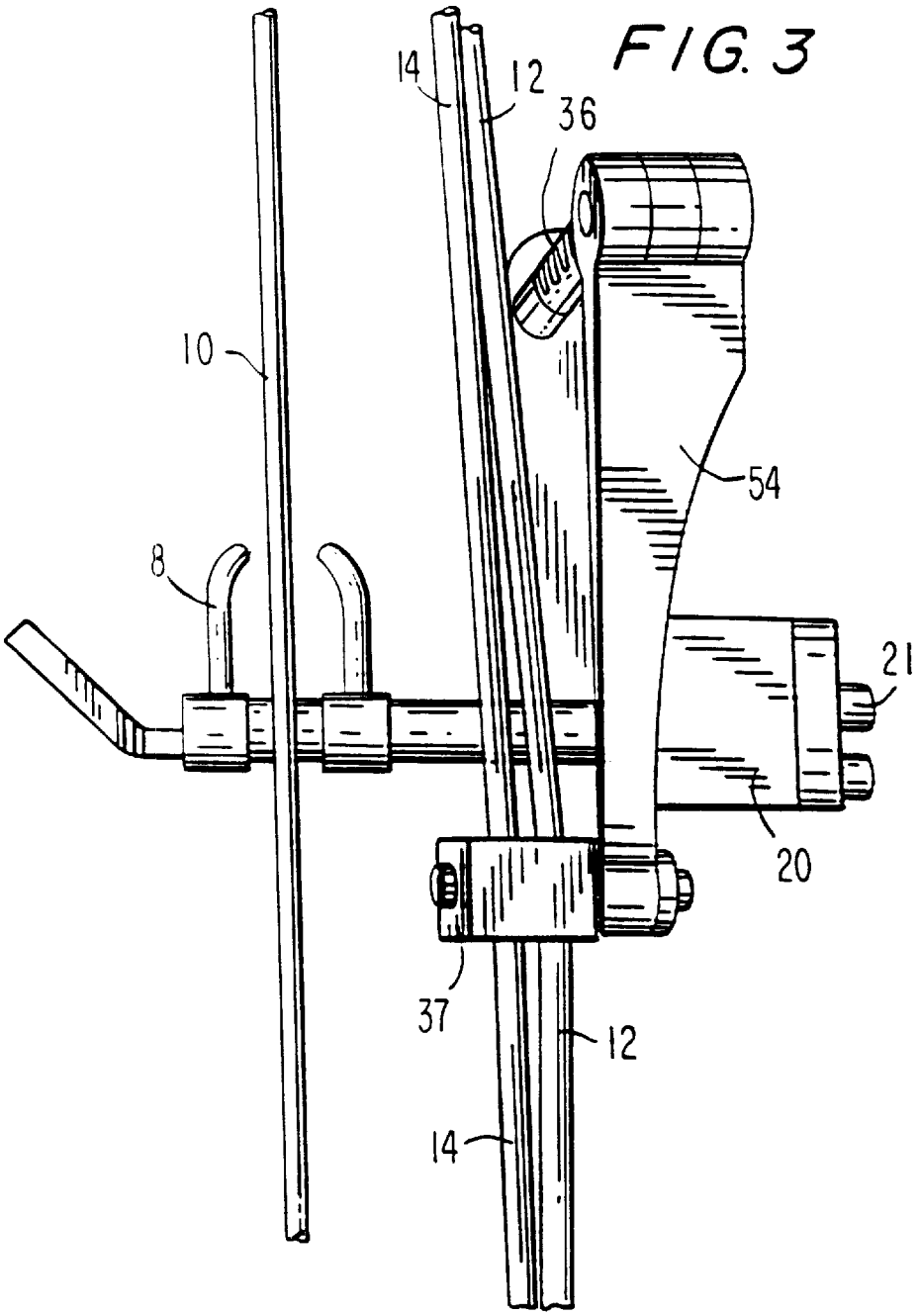
FIG. 3 is a front elevation view of the cable guard of the present invention
Figure 3A:
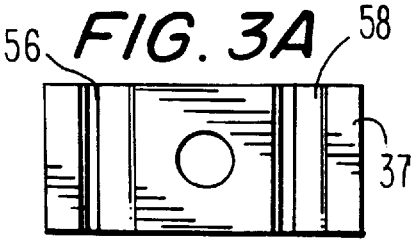
FIG. 3A is an exploded elevation view of the cable retaining means of the cable guard of the present invention.

With respect to the first embodiment of the archery bow, there is shown in FIG. 1 a cable guard 2 which is connected to the rear of an overdraw bracket 4 mounted on the outer face of a compound archery bow handle 6. Bow handle 6 is connected to bow limbs 7 and 8 in known manner. A conventional arrow rest 8 is mounted on overdraw bracket 4. A bowstring 10 and cables 12 and 14 are shown in their position relative to each other and to the handle 6 when the bow is in the brace position. The cables 12 and 14 and bowstring 10 extend over an eccentric wheel 11 and pulley 13 attached to the outer ends of the bow limbs 7 and 8. The cables 12 and 14 are spaced laterally from the bowstring 10 as seen in FIG. 3.

Figure 1A:
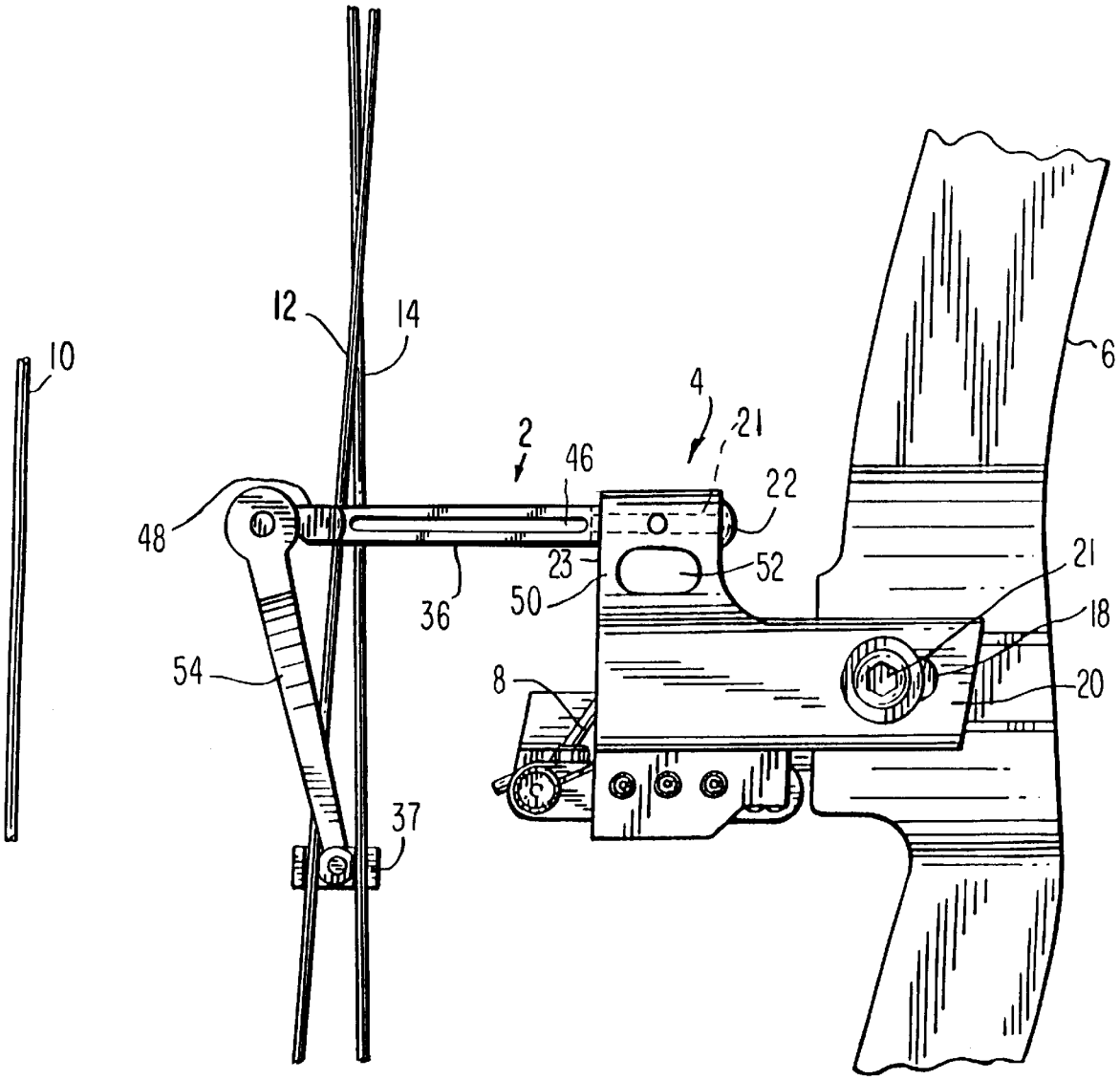
FIG. 1A is a partial side elevation view of the archery bow shown and wherein the archery bow is in the brace position.
Figure 1B:
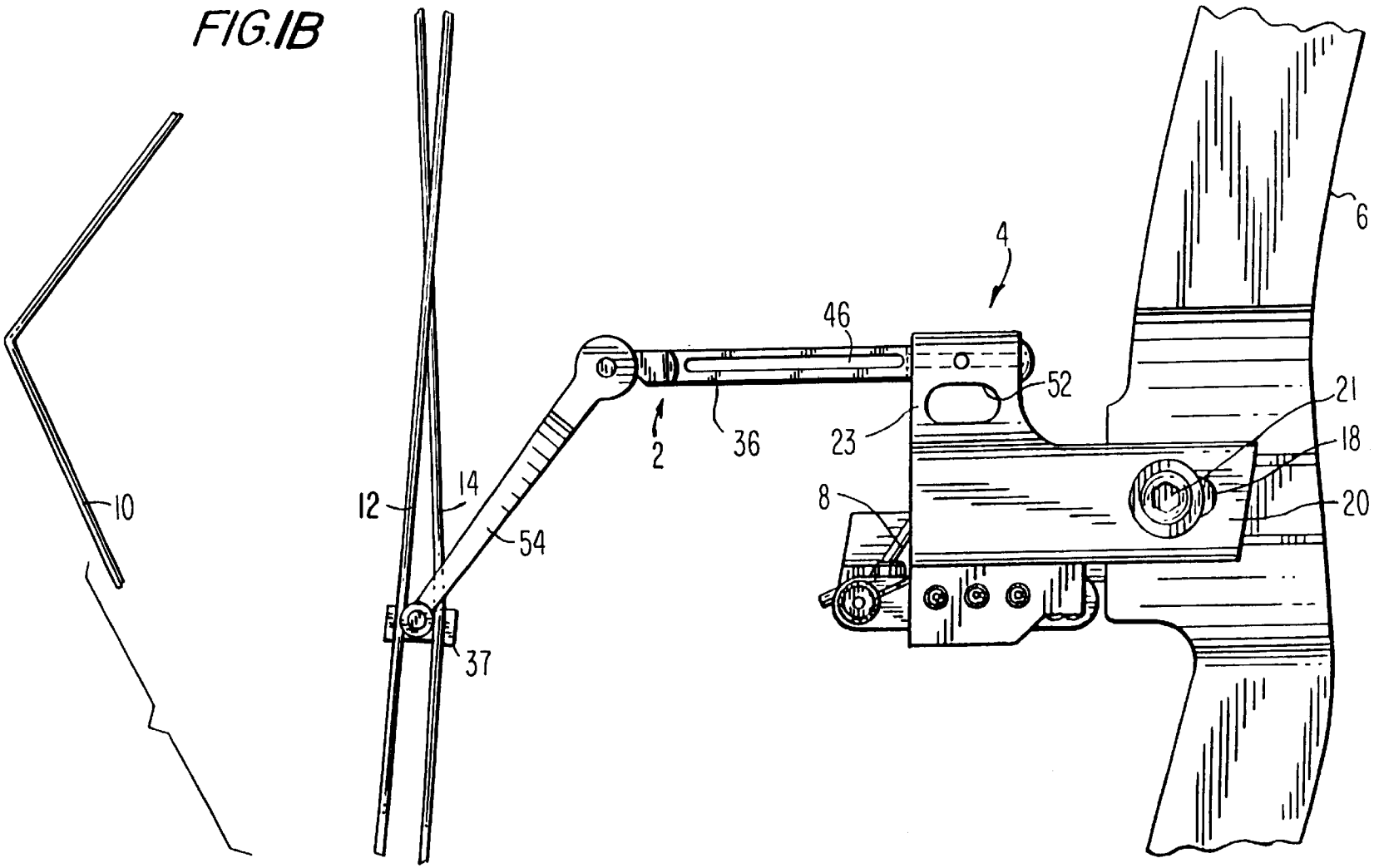
FIG. 1B is a partial side elevation view of the archery bow shown in FIG. 1 and wherein the archery bow is in the drawn position.

As seen in FIG. 1A, the overdraw bracket 4 includes an opening 16 in a rear section 18. A capscrew 21 inserted in opening 16 of overdraw bracket 4 and in an opening in archery bow handle 6 connects overdraw bracket 4 to archery bow handle 6. The opening 16 of overdraw bracket 4 allows the overdraw bracket 4 to be moved perpendicularly with respect to the handle 6 for adjustment of the arrow rest 8 with respect to the handle 6. Overdraw bracket 4 includes a horizontal circular opening 21 through which a threaded bolt 22 extends and a vertical surface 23.

An adjustment guide 24 (see FIGS. 4, 4A and 4B) includes serrated teeth 28 on one side, and legs 30 and a concave surface 32 therebetween on the other side. Legs 30 terminate in flat portions 34. Adjustment guide 24 includes a circular opening 26 which is the same size as circular opening 20 of overdraw bracket 4. The surfaces 34 of legs 30 abut the top portion of vertical surface 23 of overdraw bracket 4 and threaded bolt 22, which extends through circular opening 20 of overdraw bracket 4, also extends through circular opening 26 of adjustment guide 24.

Figure 5:
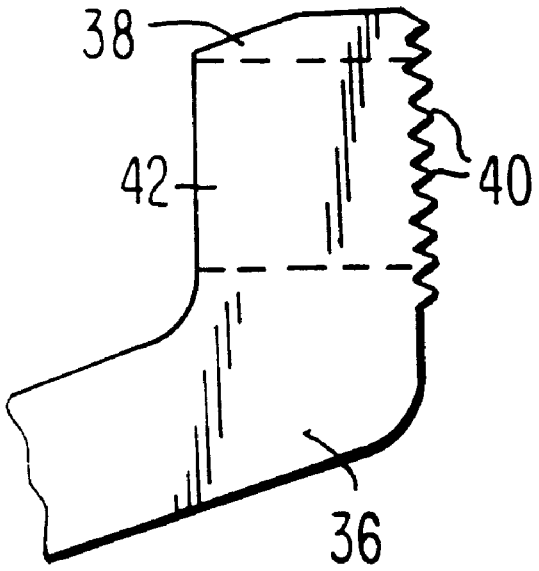
FIG. 5 is an exploded top view of the elbow portion of the cable guard supporting arm.
Figure 5A:
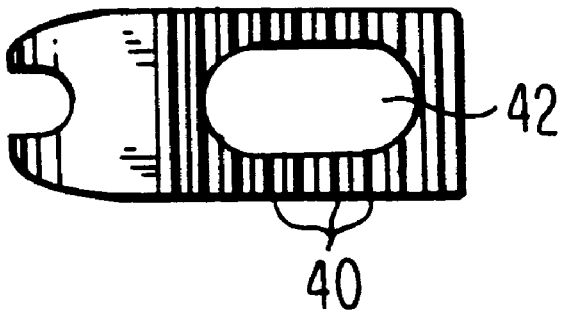
FIG. 5A is an exploded side elevation view of the elbow portion shown in FIG. 5

The cable guard 2 includes a rearwardly extending support arm 36 and connected cable restraining means 37 having an elbow portion 38. The elbow portion 38 (see FIGS. 5 and 5A) includes serrated teeth 40 which are designed to mesh with serrated teeth 28 of adjustment guide 24. Elbow portion 38 includes a horizontal oblong-shaped opening 42 whose principal axis is substantially longer than the diameter of circular opening 20 of overdraw bracket 4 and the diameter of circular opening 26 of adjustment guide 24. The threaded bolt 22 extends through circular opening 20, circular opening 26 and oblong-shaped opening 42. A nut 44, when screwed on the end of threaded bolt 22, connects the overdraw bracket 4 adjustment guide 24 and elbow portion 38 together.

It should be noted that because the circular opening 26 of adjustment guide 24 is essentially the same size as threaded bolt 22, the adjustment guide 24 is not moveable relative to the threaded bolt 22. On the other hand, the oblong-shaped opening 42 of elbow portion 38 of support arm 36 is substantially larger than the diameter of threaded bolt 22 and therefore support arm 36 is moveable laterally relative to threaded bolt 22 to various distances from bowstring 10. Thus, for example, in FIG. 6 it is seen that threaded bolt 22 is in engagement with that portion of the oblong-shaped opening 42 of elbow portion 38 closest to the bowstring 10 and laterally from bow handle. In this position, elbow portion 38 and therefore support arm 36 and cable restraining means 37 is farthest from the bowstring. This position would be desirable when the arrow fletching is of greater thickness and a larger distance between the support arm 36 and the bowstring 10 is required to permit free passage of the arrow.

Figure 6:
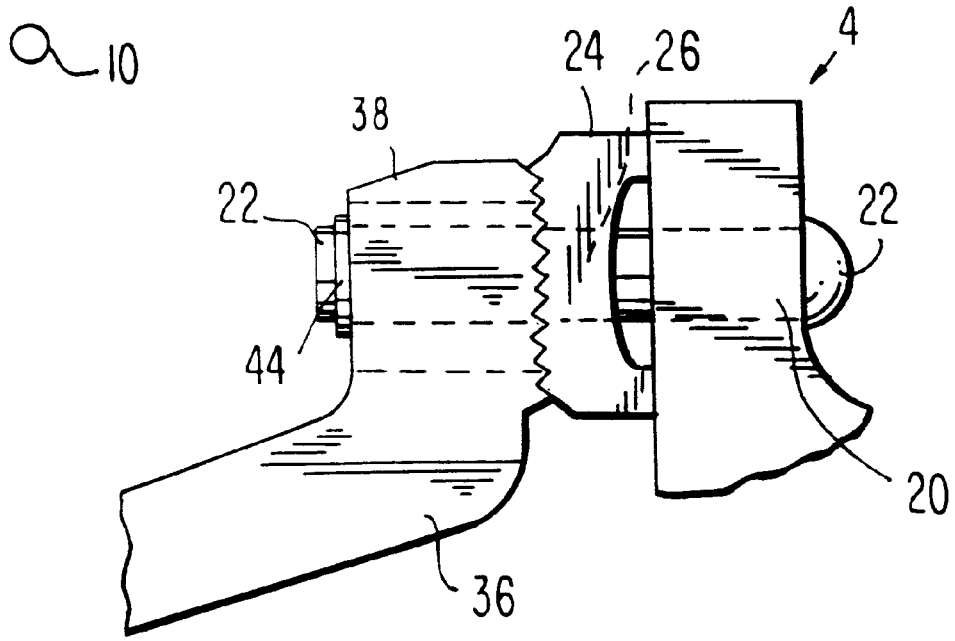
FIG. 6 is an exploded top view of the cable guard shown in FIG. 1A at a first distance from the bowstring.
Figure 6A:
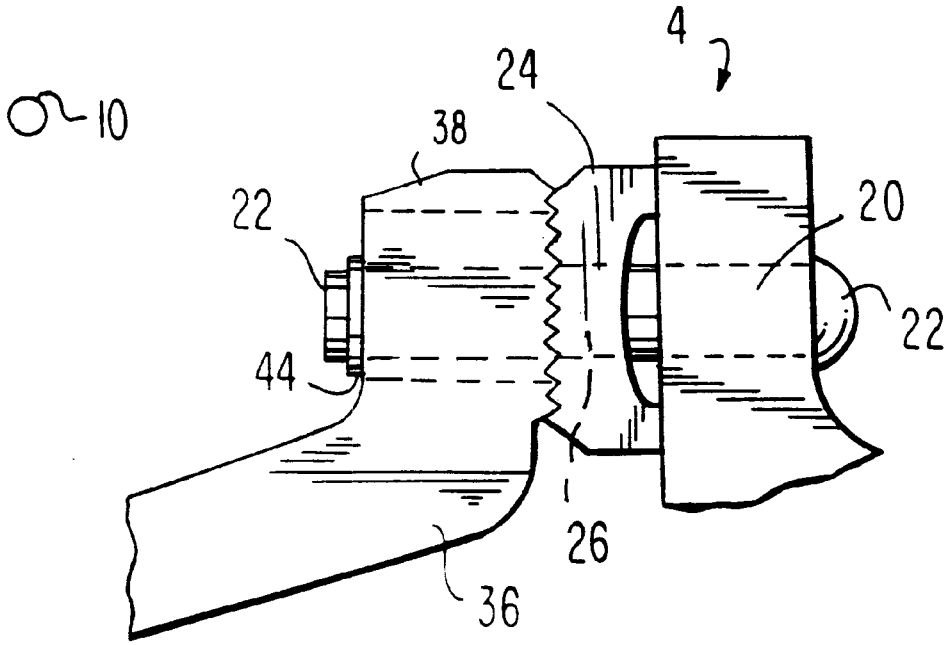
FIG. 6A is an exploded top view of the cable guard shown in FIG. 1A at a second, closer distance to the bowstring.

On the other hand, in FIG. 6A, the threaded bolt 22 is in engagement with that portion of the oblong-shaped opening 42 of elbow portion 38 farthest from bowstring 10. In this position, elbow portion 38 and therefore support arm 36 and cable restraining means 37 are closest to the bowstring. This position would be desirable when the arrow fletching is of less thickness and a smaller distance between the support arm 36 and the bowstring 10 is required to permit free passage of the arrow.

The elbow portion 38 of support arm 36 may be located with respect to the adjustment guide 24 at various positions intermediate those illustrated in FIGS. 6 and 6A by simply loosening nut 44 from threaded bolt 22, moving elbow portion 38 to the desired position, and securing nut 44 on threaded bolt 22. In each such position, the lateral distance between the support arm 36 and bow handle 6 will be varied. In each instance, the position selected should be that which will allow the cable retaining means and the bowstring to be as close as practicable while still permitting the free passage of the arrow. It will be noted that whatever position is selected, serrated teeth 28 of adjustment guide 24 will be in mesh with serrated teeth 40 of elbow portion 38 to form a strong connection between the adjustment guide 24 and support arm 36.

Figure 2:
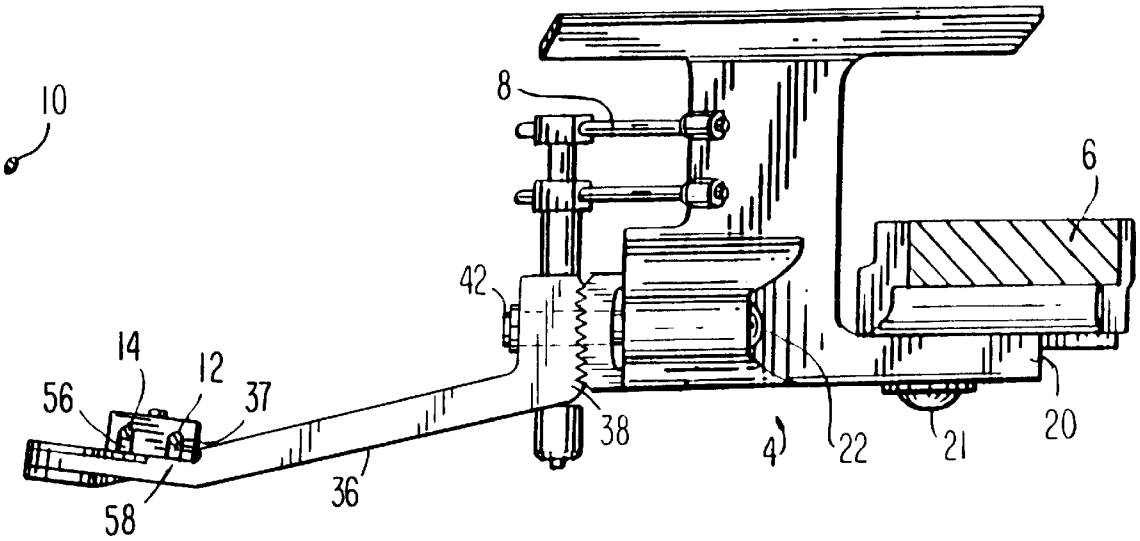
FIG. 2 is a top view of the archery bow and wherein the archery bow shown in FIG. 1 is in the brace position.
Figure 2A:
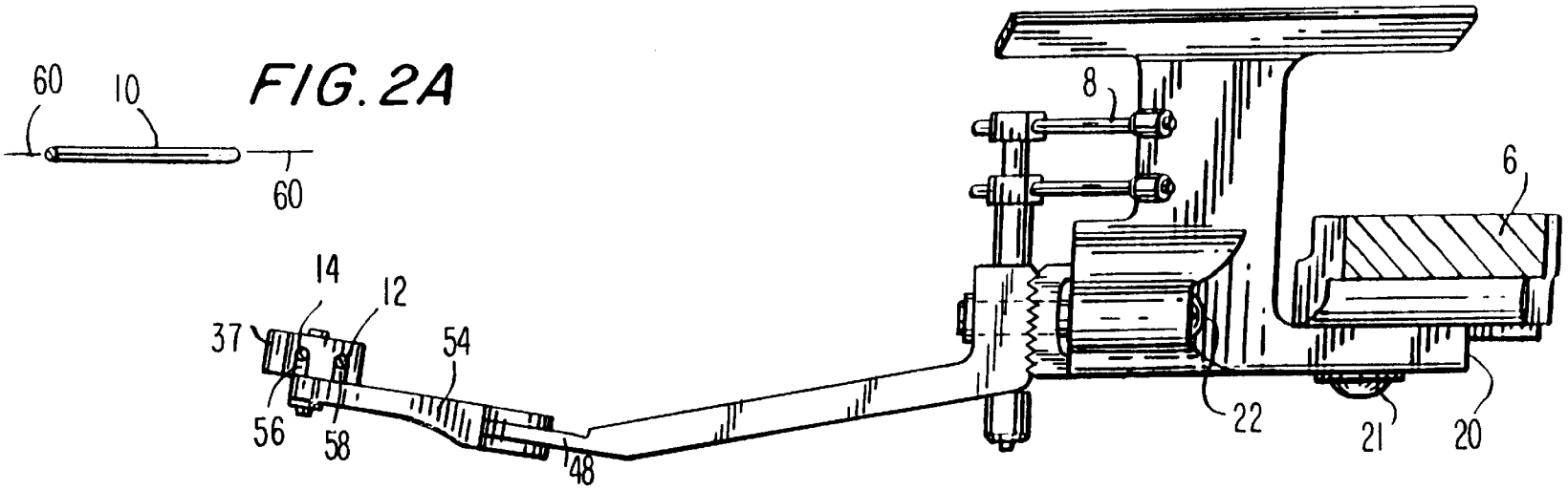
FIG. 2A is a top view of the cable guard shown in FIG. 1A and wherein the archery bow shown in FIG. 1 is in the drawn position.

The cable guard 2 includes a recessed portion 46 extending the length of support arm 36 to decrease the weight of support arm 36. Support arm 36 is perpendicular to the axis of the bowstring 10 at brace and to the vertical axis of the archery bow handle 6. As best seen in FIGS. 2 and 2A, the pivot end 48 of support arm 36 is angled inward in the direction of the bowstring 10. The overdraw bracket 4 includes side sections 50 having an opening 52 therein for weight reduction practices. A swing arm 54 is pivotally connected to support arm 36 at pivot end 48. The cable retaining means 37 is pivotally connected to the other end of swing arm 54 and includes openings 56 and 58 which retain cables 12 and 14.

The operation of cable guard 2 is best seen in FIG. 1 wherein the bow is in the brace position and FIG. 1A wherein the bow is in the drawn position. When bowstring 10 is drawn, cables 12 and 14 move in the direction of bowstring 10 and both cable retaining means 37 and swing arm 54 are caused to be pivoted clockwise to the position shown in FIG. 1A. Since, as seen in FIGS. 2 and 2A, the cable retaining means 37 and swing arm 54 are caused to be pivoted clockwise to the position shown in FIG. 1A and the cable retaining means 37 moves closer to the plane of the bowstring travel 60 as the bowstring 10 is drawn, the normal forces of the cables 12 and 14 against openings 56 and 58 of retaining means 37 and the attendant frictional forces generated thereby are reduced. In addition, because cables 12 and 14 are closest to the bowstring 10, there is less torque on the bow limbs in comparison to the condition wherein the retainer means moves in a plane parallel to the travel of the bowstring. Also, because the retaining means 37 is pivotally mounted on the swing arm 54, there is greater freedom and reduced frictional forces between the cables 12 and 14 and retaining means 37.

The archery bow, illustrated in FIGS. 7 to 10A, differs principally from of the archery bow illustrated in FIGS. 1 to 6A in the manner in which the cable guard 2 is secured to the archery bow. In general, in the archery bow illustrated, in FIGS. 1 to 6A cable guard 2 is secured to the adjustment guide 24, whereas in the archery bow illustrated in FIGS. 7 to 10A, cable guard 2 is secured directly to handle 4. For simplicity purposes, the discussion of the archery bow will be directed to the differences in the archery bows.

Figure 7:
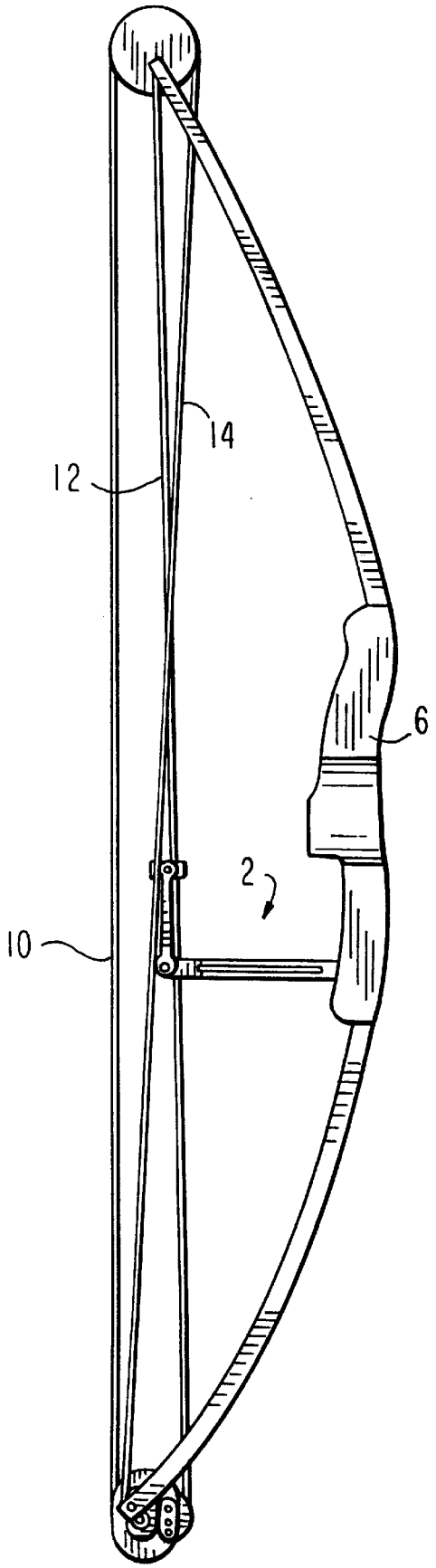
FIG. 7 is a side elevation view of an archery bow including the incrementally adjustable compound archery bow cable guard of the present invention wherein the cable guard is directly connected to the bow handle.
Figure 7A:
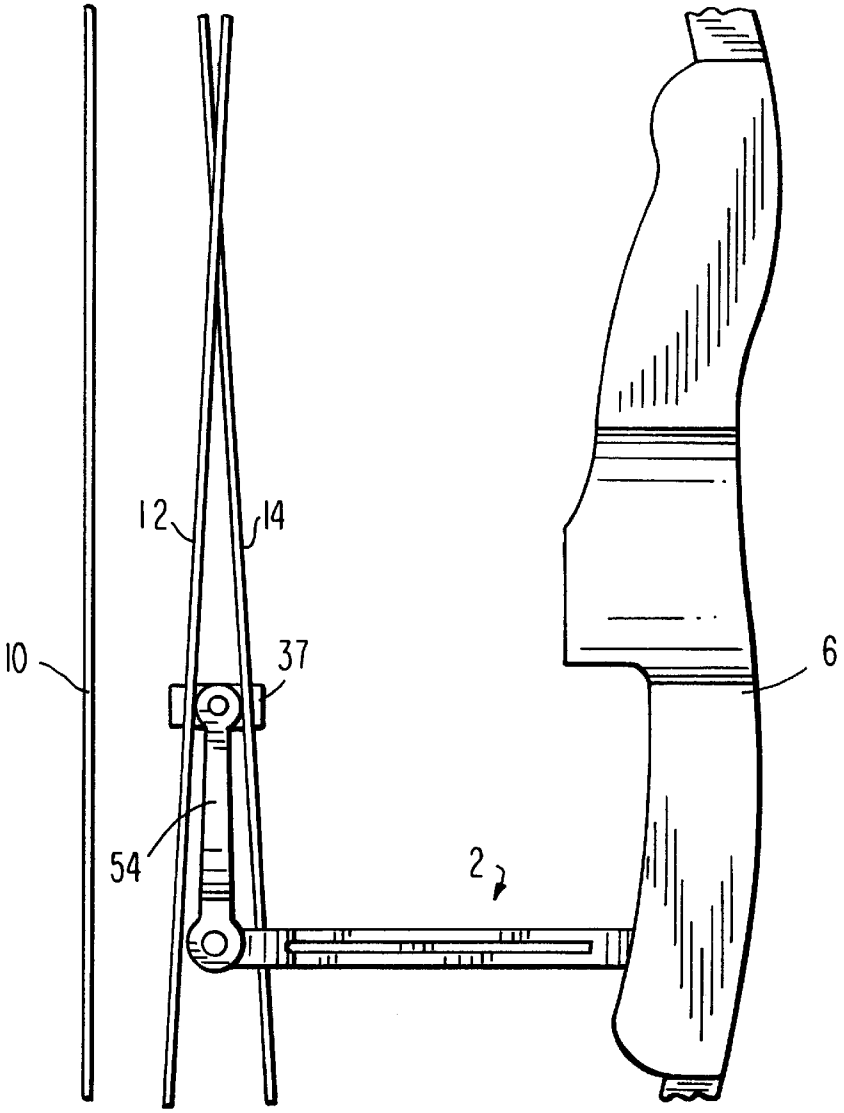
FIG. 7A is a partial side elevation view of the archery bow shown in FIG. 7 and wherein the archery bow is in the brace position.
Figure 8:
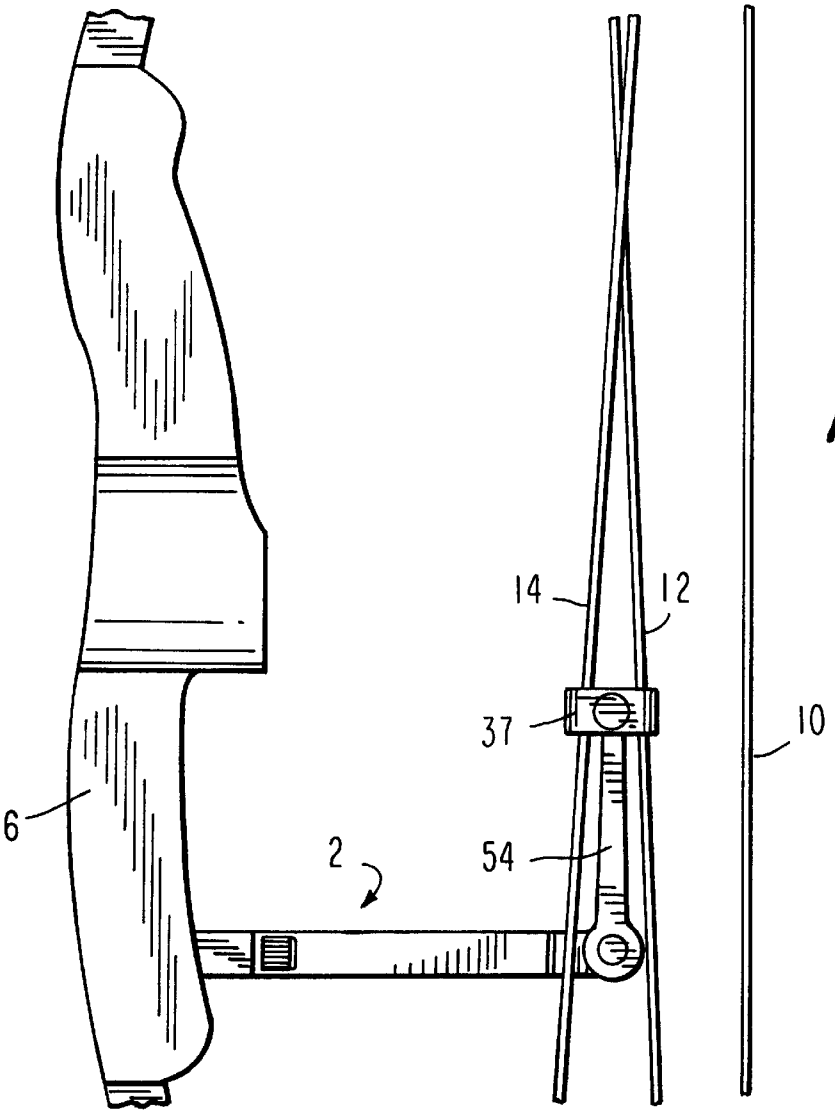
FIG. 8 is a partial side elevation view of the cable guard shown in FIG. 7A as seen from the opposite side of the archery bow.

Thus in FIGS. 7 and 8 the cable guard 2 is connected to the archery bow handle 6. Archery bow handle 6 includes a portion 62 having serrated teeth 64 best seen in FIGS. 9 and 9A. A threaded circular opening 66 extends through portion 62. Serrated teeth 64 are designed to mesh with serrated teeth 40 of elbow portion 38 of cable guard 2. A threaded bolt 68, which includes two interconnecting metallic washers 70 and 72 thereon, extends through oblong-shaped opening 42 of the elbow portion 38 of cable guard 2, and into threadable engagement with the threaded circular opening 66 of handle portion 62 to secure the cable guard 2 and handle 6 together.

Figure 10:
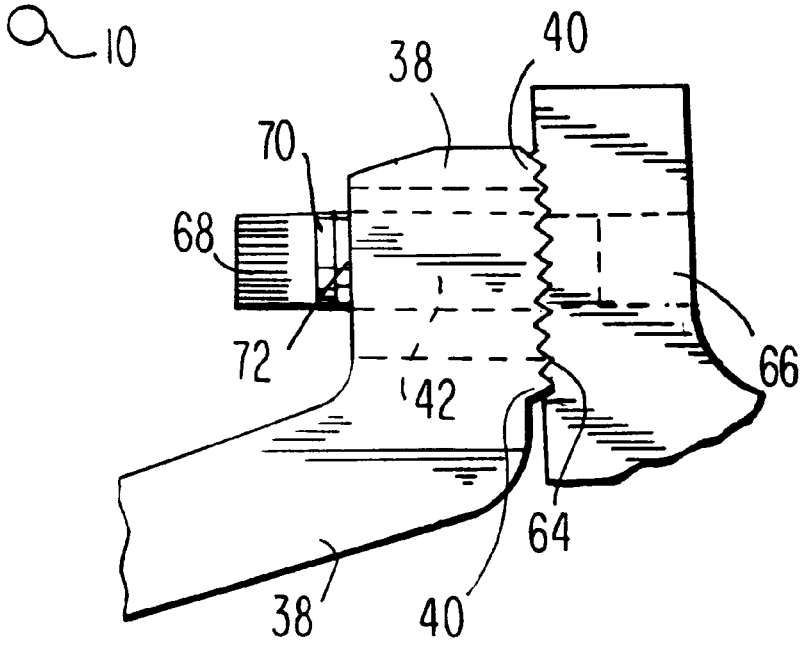
FIG. 10 is an exploded top view of the cable guard of the present invention directly attached to the bow handle and at a first distance from the bowstring.

The oblong-shaped opening 42 of elbow portion 38 of support arm 36 is substantially larger than the diameter of threaded bolt 68 and therefore support arm 36 is moveable laterally relative to threaded bolt 68 to various distances from bowstring 10 and laterally from bow handle 6. Thus, for example, in. FIG. 10 it is seen that threaded bolt 68 is in engagement with that portion of the oblong-shaped opening 42 of elbow portion 38 closest to the bowstring 10. In this position, elbow portion 38 and therefore support arm 36 and cable restraining means are farthest from the bowstring. This position would be desirable when the arrow fletching is of greater thickness and a larger distance between the support arm 36 and the bowstring 10 is required to permit free passage of the arrow.

Figure 10A:
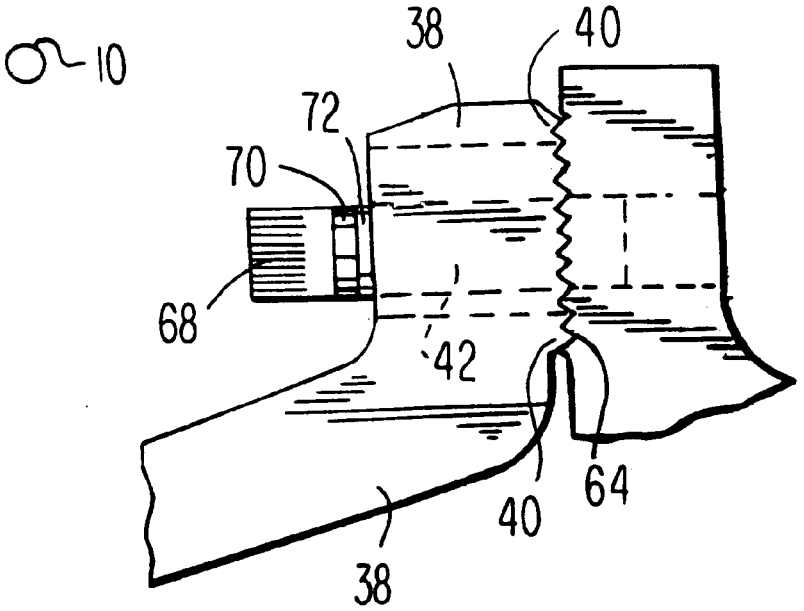
FIG. 10A is an exploded top view of the cable guard of the present invention directly attached to the bow handle and at a second distance from the bowstring.
Figure 11:
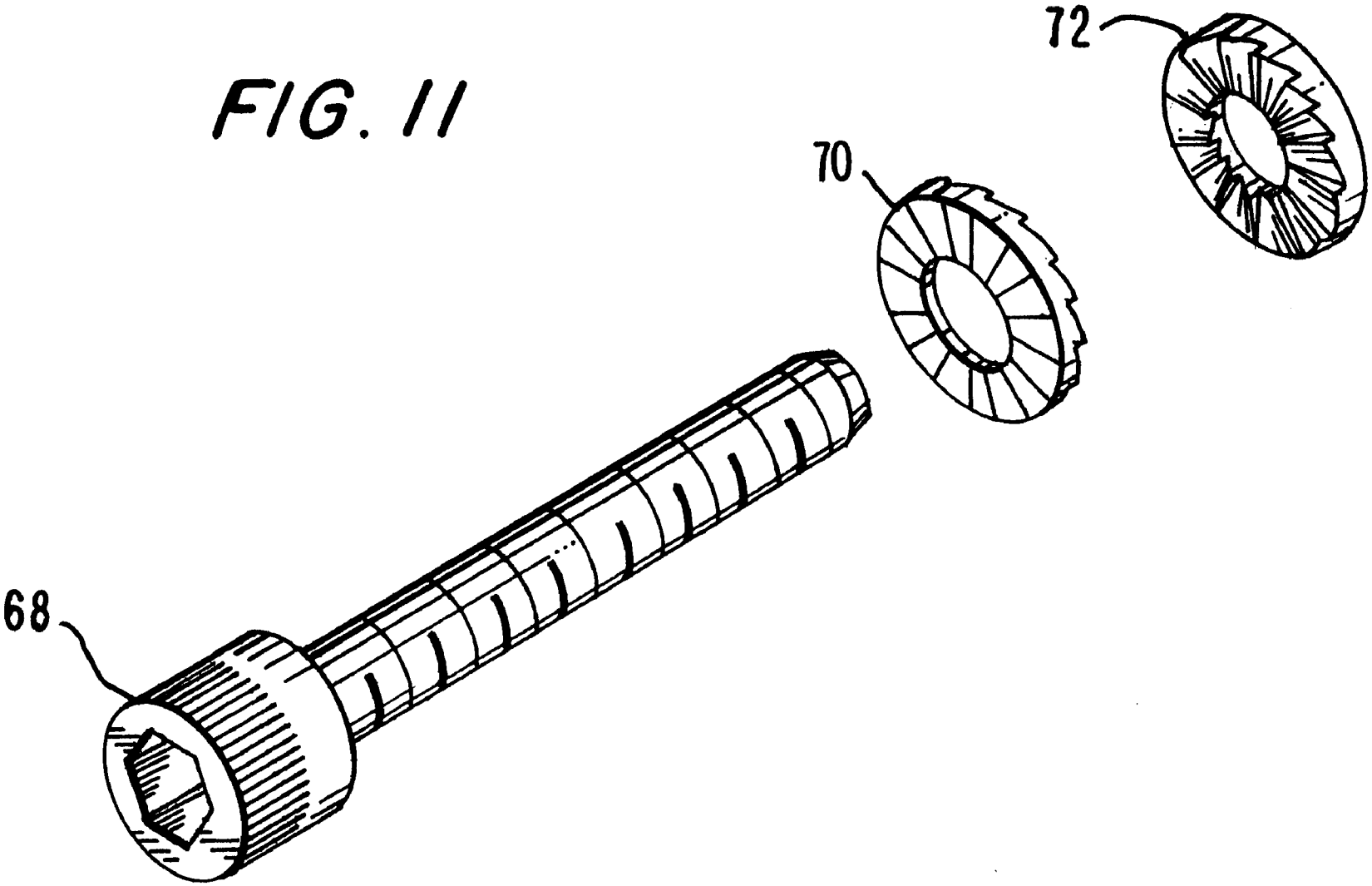
FIG. 11 is a perspective view of the threaded bolt and locking washers utilized in the present invention.

On the other hand, in FIG. 10A, the threaded bolt 68 is in engagement with that portion of the oblong-shaped opening 42 of elbow portion 38 farthest from the bowstring 10. In this position, elbow portion 38 and therefore support arm 36 and cable restraining means 37 are closest to the bowstring. This position would be desirable when the arrow fletching is of less thickness and a smaller distance between the support arm and the bowstring is required to permit free passage of the arrow.

The elbow portion 38 of support arm 36 may be located with respect to the adjustment guide 24 at various positions intermediate those illustrated in FIGS. 10 and 10A by simply disengaging threaded bolt 68 from threaded circular opening 66 of handle portion 62 and moving elbow portion 38 to the desired position and then again engaging the threaded bolt 68 in the threaded circular opening 66 of handle portion 62. Here again, in each such position, the lateral distance between the support arm 36 and bow handle 6 will be varied. In each instance, the position selected should be that which will allow the cable retaining means and the bowstring to be as close as practicable while still permitting the free passage of the arrow. It will be noted that whatever position is selected, serrated teeth 64 of handle portion 62 will be in mesh with serrated teeth 40 of elbow portion 38 to form a strong connection between the handle 6 and support arm 36.

It is emphasized that the incrementally adjustable compound archery bow cable guard of the present invention is not limited to use with the particular cable guard described above. Rather, the present invention may be used with other cable guards in which it is desired that the cable retaining means and bowstring be as close as practicable while still permitting the passage of an arrow.

Having thus described the invention, it will be apparent to those skilled in the art that various modifications can be made within the scope of the invention. It is therefore understood that the present invention may be practiced otherwise than as specifically described.

I claim:

1. A compound archery bow comprising an incrementally adjustable cable guard, a bowstring, a handle, a pair of bow limbs and a return cable, said incrementally adjustable cable guard comprising a support arm affixed to the bow;

cable retaining means mounted on the support arm; and noncircular means on said support arm for laterally adjusting the distance between the support arm and the bowstring.

2. A compound archery bow as recited in claim 1 wherein the means on said support arm for adjusting the distance between the support arm and the bowstring comprises an opening therein.

3. A compound archery bow as recited in claim 2 which further includes an adjustment guide having an opening therein of smaller size than the opening in the support arm.

4. A compound archery bow as recited in claim 3 and further including a threaded bolt which extends through the opening in the adjustment guide and the opening in the support arm for connecting the adjustment guide and support arm.

5. A compound archery bow as recited in claim 1 wherein the means on said support arm for adjusting the distance between the support arm and the bowstring comprises a serrated surface.

6. A compound archery bow as recited in claim 5 and further including an adjustment guide having an opening therein of smaller size than the opening in the support arm.

7. A compound archery bow as recited in claim 6 and wherein the adjustment guide includes a serrated surface for meshing with the serrated surface of said support arm.

8. A compound archery bow comprising an incrementally adjustable cable guard, a bowstring, a handle, an overdraw bracket, a pair of bow limbs and a return cable, said incrementally adjustable cable guard comprising a support arm affixed to the overdraw bracket;

cable retaining means mounted on the support arm; and noncircular means on said support arm for laterally adjusting the distance between the support arm and the bowstring.

9. A compound archery bow as recited in claim 8 wherein the means on said support arm for adjusting the distance between the support arm and the bowstring comprises an opening therein.

10. A compound archery bow as recited in claim 9 which further includes an adjustment guide having an opening therein of smaller size than the opening in the support arm.

11. A compound archery bow as recited in claim 10 and further including a threaded bolt which extends through the opening in the adjustment guide and the opening in the support arm for connecting the adjustment guide and support arm.

12. A compound archery bow as recited in claim 8 wherein the means on said support arm for adjusting the distance between the support arm and the bowstring comprises a serrated surface.

13. A compound archery bow as recited in claim 12 and further including an adjustment guide having an opening therein of smaller size than the opening in the support arm.

14. A compound archery bow as recited in claim 13 and wherein the adjustment guide contains a serrated surface for meshing with the serrated surface of said support arm.

15. A compound archery bow comprising an incrementally adjustable cable guard, a bowstring, a handle, a pair of bow limbs and a return cable, said incrementally adjustable cable guard comprising a support arm affixed to the handle;

cable retaining means mounted on the support arm; and noncircular means on said support arm for laterally adjusting the distance between the support arm and the bowstring.

16. A compound archery bow as recited in claim 15 wherein the means on said support arm for adjusting the distance between the support arm and the bowstring comprises an opening therein.

17. A compound archery bow as recited in claim 16 wherein the means on said support arm for adjusting the distance between the support arm and the bowstring comprises a serrated surface.

18. A compound archery bow as recited in claim 17 in which the handle comprises a serrated surface for meshing with the serrated surface of the support arm.

19. A compound archery bow as recited in claim 16 which further includes a threaded opening in the handle of smaller size than the opening in the support arm.

20. A compound archery bow as recited in claim 19 and further including a threaded bolt which extends through the opening in the handle and the opening in the support arm for connecting the adjustment guide and support arm together.

* * * * *